US008931441B2

(12) United States Patent
Beyer et al.

(10) Patent No.: US 8,931,441 B2
(45) Date of Patent: Jan. 13, 2015

(54) ENGINE ASSEMBLY

(75) Inventors: Theodore Beyer, Canton, MI (US); Jody Michael Slike, Farmington Hills, MI (US); Xingfu Chen, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 294 days.

(21) Appl. No.: 13/420,372

(22) Filed: Mar. 14, 2012

(65) Prior Publication Data

US 2013/0239915 A1 Sep. 19, 2013

(51) Int. Cl.
*F02F 1/40* (2006.01)

(52) U.S. Cl.
USPC ..... 123/41.82 R; 123/193.5

(58) Field of Classification Search
USPC ..... 123/193.5, 41.82 R
IPC ..... F02F 1/36
See application file for complete search history.

(56) References Cited

U.S. PATENT DOCUMENTS

| | | | | |
|---|---|---|---|---|
| 3,102,381 | A | 9/1963 | Tryhorn | |
| 3,170,452 | A | 2/1965 | Dobovan | |
| 4,009,693 | A * | 3/1977 | Bailey et al. | 123/41.82 A |
| 4,033,303 | A | 7/1977 | Wu et al. | |
| 4,522,161 | A | 6/1985 | Slee | |
| 4,690,105 | A * | 9/1987 | Kanda | 123/41.82 R |
| 5,081,960 | A * | 1/1992 | Shimamoto | 123/41.82 R |
| 5,745,993 | A | 5/1998 | Adachi et al. | |
| 5,802,716 | A | 9/1998 | Nishimura et al. | |
| 7,063,051 | B2 | 6/2006 | Schellhase | |
| 7,784,442 | B2 * | 8/2010 | Lester et al. | 123/193.5 |
| 2009/0133647 | A1 * | 5/2009 | Yamagata | 123/41.82 R |
| 2009/0260588 | A1 * | 10/2009 | Hong | 123/41.82 R |
| 2011/0271916 | A1 * | 11/2011 | Steiner et al. | 123/41.82 R |

* cited by examiner

*Primary Examiner* — M. McMahon
(74) *Attorney, Agent, or Firm* — Julia Voutyras; Alleman Hall McCoy Russell & Tuttle LLP

(57) ABSTRACT

An engine cylinder head is provided. The engine cylinder head includes a portion of a first combustion chamber, an upper coolant core and a lower coolant core directing heat from the first combustion chamber and including a first coolant passage and a second coolant passage, the first coolant passage and the second coolant passage laying along a lateral axis, at least a portion of the first coolant passage separated from the second coolant passage via first and second walls.

7 Claims, 8 Drawing Sheets

ENGINE ASSEMBLY

BACKGROUND/SUMMARY

Cooling jackets, such as water jackets, are used in engines to remove heat from the engine assembly and provide cooling to various engine components. Therefore, the likelihood of thermal degradation of the engine block and the components coupled thereto may be reduced. Moreover, the cooling jackets may enable the combustion chamber to be maintained at a desirable operating temperature or within a desirable operating temperature range, thereby increasing combustion efficiency. Cooling jackets may be integrated into both the cylinder head and/or the cylinder block to facilitate temperature regulation in different sections of the engine.

U.S. Pat. No. 5,745,993 discloses an engine having a water jacket integrated into a cylinder head. Water is flowed through the water jacket in the cylinder head as well as a water jacket in the cylinder block to remove heat from the engine generated during combustion. The water jacket includes a first passage positioned below an exhaust port and adjacent to an exhaust valve seat as well as a second passage positioned adjacent to another portion of the exhaust valve seat and the intake valve. As a result, uneven cooling of the valve seat may occur, thereby warping the valve seat. Warping of the valve seat may cause the valve to only partially seal the combustion chamber, thereby degrading combustion operation. In particular, gases may flow out of the combustion chamber during compression, and/or power strokes, thereby decreasing combustion efficiency.

Therefore, in one approach, an engine cylinder head is provided. The engine cylinder head includes a portion of a first combustion chamber, an upper coolant core and a lower coolant core directing heat from the first combustion chamber and including a first coolant passage and a second coolant passage, the first coolant passage and the second coolant passage laying along a lateral axis, at least a portion of the first coolant passage separated from the second coolant passage via first and second walls.

When the aforementioned cylinder head is utilized, the likelihood of valve seat warping may be reduced while at the same time providing cooling to the cylinder head and specifically the exhaust manifold. Consequently, warping of the valve seat may be avoided while maintaining the cylinder head within a desired operating temperature. Therefore, the combustion chamber may be operated within a desirable temperature range, increasing combustion efficiency without negatively affecting the shape of the cylinder head and specifically the valve seat via warping.

The above advantages and other advantages, and features of the present description will be readily apparent from the following Detailed Description when taken alone or in connection with the accompanying drawings. For example, while the examples provided herein show axial displacement of the core, rotational displacement (or combinations of axial and rotational displacement) may also be used.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 2-5 and 8 are drawn approximately to scale.

DETAILED DESCRIPTION

Figure 1:
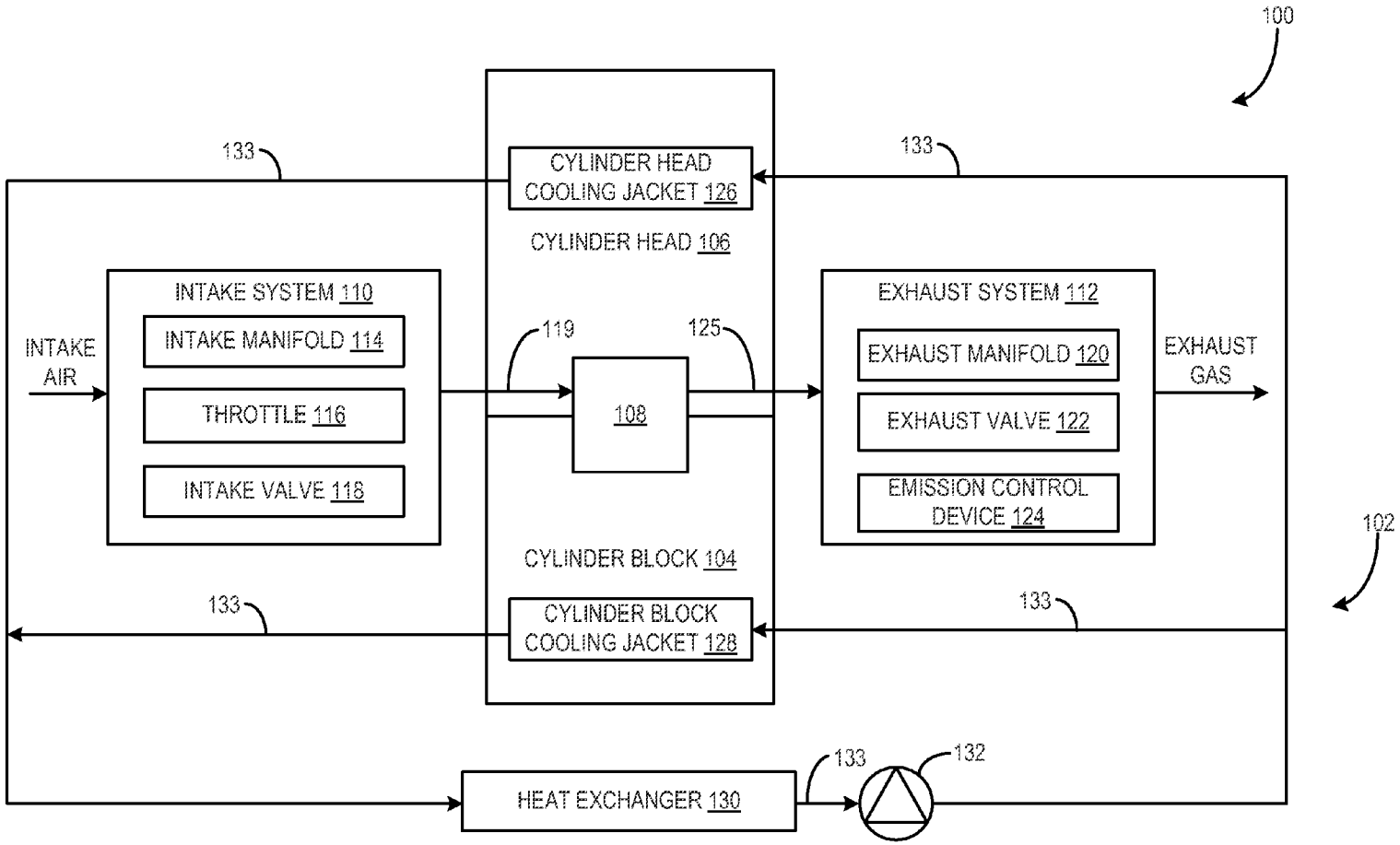
FIG. 1 shows a schematic depiction of an engine assembly.

FIG. 1 shows a schematic depiction of an engine assembly 100 and cooling system 102. As shown, the engine includes a cylinder block 104 coupled to a cylinder head 106 forming at least one combustion chamber 108. The cylinder head 106 may be referred to as an engine cylinder head. The cylinder head 106 may constructed via a single casting, in some examples. Likewise, the cylinder block 104 may be constructed via a single casting, in some examples. Thus, the cylinder head 106 and/or cylinder block 104 may each be formed out of a single continuous piece of material. Suitable materials that may be used to construct the cylinder block 104 include aluminum, iron, and/or magnesium. Suitable materials that may be used to construct the cylinder head 106 include aluminum and/or iron.

The engine assembly 100 further includes an intake system 110 and an exhaust system 112. The intake system 110 is configured to provide intake air to the combustion chamber 108 and may include an intake manifold 114, throttle 116, intake valve 118, etc. The throttle 116 may be electronic and configured to control air flow into the combustion chamber 108. The throttle 116 may be controlled via controller 200 shown in FIG. 2, discussed in greater detail herein. Arrow 119 denotes the flow of air into the combustion chamber 108. It will also be appreciated that when port injection is used in the engine assembly 100 arrow 119 may also denote the flow of fuel into the combustion chamber 108.

The exhaust system 112 is configured to receive exhaust gases from the combustion chamber 108 and may include an exhaust runner 120, an exhaust valve 122, one or more emission control devices 124 (e.g., catalyst, filter), etc. Additional components that may be included in the engine assembly 100 may include a turbocharger and an exhaust gas recirculation (EGR) system, in some examples. Arrow 125 denotes the flow of exhaust gas from the combustion chamber 108 to the exhaust system 112.

The cooling system 102 may include a cylinder head cooling jacket 126 integrated into the cylinder head 106. Additionally in some examples, the cooling system 102 further includes a cylinder block cooling jacket 128 integrated into the cylinder block 104. The cylinder head cooling jacket 126 and the cylinder block cooling jacket 128 may each include a plurality of passages circulating coolant around the engine. In the depicted example, the cooling jackets (126 and 128) are coupled in a parallel flow configuration. However, other flow configurations have been contemplated. For instance, the cooling jackets may be coupled in a series flow configuration or a combination of a series and parallel flow configuration may be utilized, in some examples.

Additionally, in the depicted example, both the cylinder head cooling jacket 126 and the cylinder block cooling jacket 128 are in fluidic communication with heat exchanger 130. The heat exchanger 130 is configured to transfer heat from the cooling system to an external fluid, such as the surrounding air, a heat transfer fluid, etc. However in other examples, each cooling jacket may be included in separate cooling circuits having separate heat exchangers.

The cooling system 102 further includes a pump 132 configured to provide pressure head to the cooling system 102. As a result, fluid may be circulated in the cooling system 102. Although the pump 132 is positioned downstream of the heat exchanger 130, the pump may be in another location, in other examples. Additionally, the working fluid in the cooling system 102 may include water, antifreeze, or other suitable coolant. It will be appreciated that the cooling system 102 may be operated to maintain the combustion chamber 108, cylinder head 106, and/or cylinder block 104 within a pre-determined temperature range. Specifically, the pump 132 may be operated to maintain the engine assembly 100 and specifically the combustion chamber 108 within a desired operating temperature range, which may be pre-determined. Controller 200 shown in FIG. 2 discussed in greater detail herein may be used to control pump 132. The likelihood of thermal degradation of the engine assembly 100 is reduced and the efficiency of the combustion may be increased when the temperature of engine assembly 100 is maintained in a desirable range. Arrows 133 denote the flow of coolant in the cooling system 102.

Although a single combustion chamber 108 is depicted in FIG. 1, it will be appreciated that in other examples, a plurality of combustion chambers may be included in the engine assembly 100. Furthermore, a reciprocating piston may be positioned in the combustion chamber 108. The piston may be coupled to and configured to rotate a crankshaft. In turn, the crankshaft may be configured to provide rotational energy to one or more drive wheels via a drive-train which may include a flywheel, a gear box, a clutch, etc.

A fuel injector (not shown) may also be coupled to the combustion chamber 108. Alternatively, fuel may be injected from an intake port, which is known to those skilled in the art as port injection. Still further in some examples, a combination of port and direct injection may be utilized. Fuel may be delivered to the fuel injector by a fuel system (not shown) including a fuel tank, fuel pump, and fuel rail (not shown). A high pressure, dual stage, fuel system may be used to generate higher fuel pressures at the injector. However, in other examples another suitable fuel injector may be utilized.

In some examples, the engine assembly 100 may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within the engine assembly 100 typically undergoes a four stroke cycle: the cycle includes the intake stroke, compression stroke, expansion stroke, and exhaust stroke. It will be appreciated that the intake valve 118 and the exhaust valve 122 may be cyclically actuated to perform the aforementioned combustion cycles.

Figure 2:
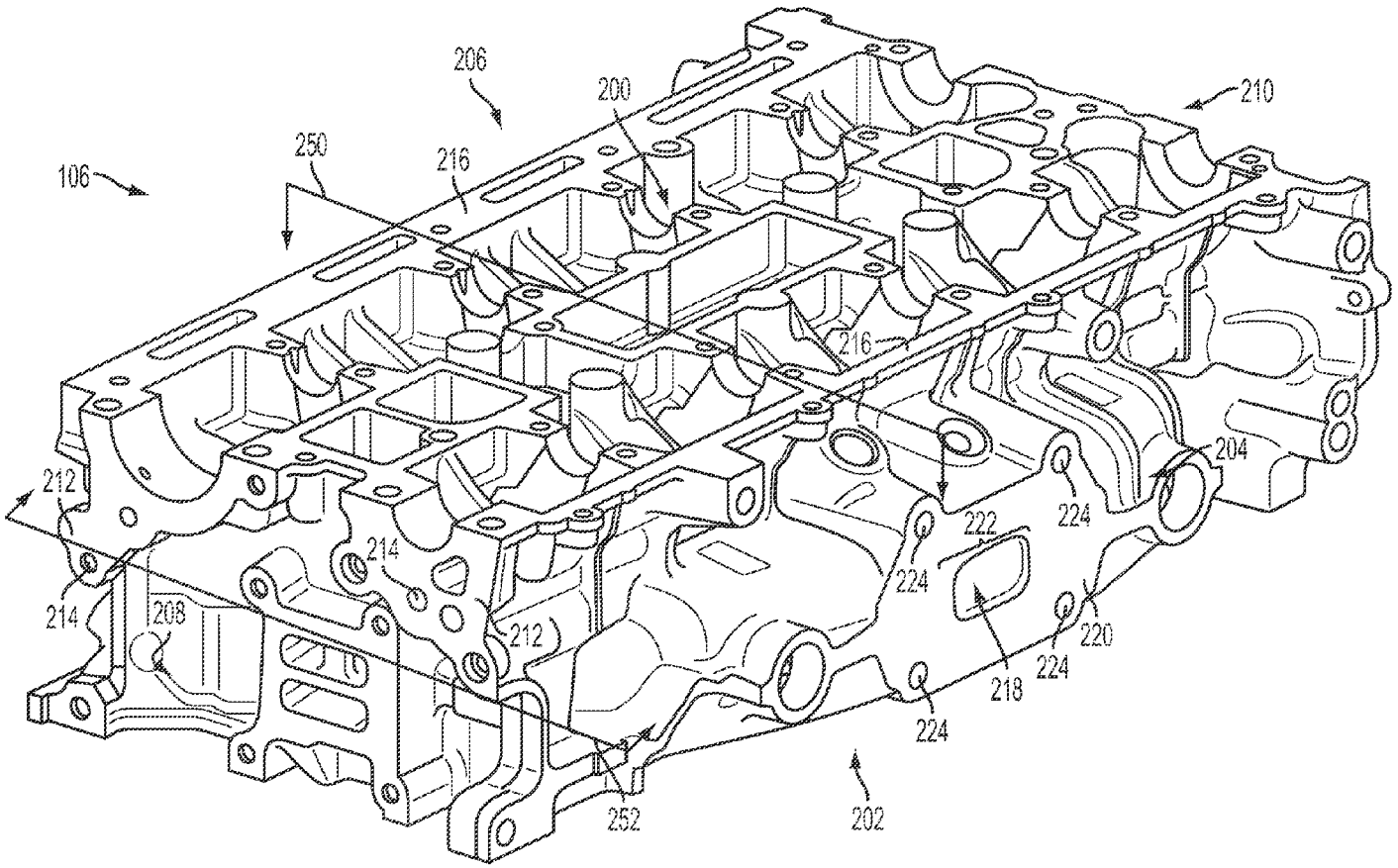
FIG. 2 shows a first view of an example cylinder head included in the engine assembly 100 shown in FIG. 1.

FIG. 2 shows a perspective view of an example cylinder head 106. The cylinder head 106 includes a top side 200, a bottom side 202, an exhaust side 204, an intake side 206, a front side 210, and a rear side 208. The rear side 208 includes an engine cover engaging surface 212. Attachment openings 214 are included in the engine cover engaging surface 212. The top side 200 includes a cam cover engaging surface 216 configured to attach to a cam cover. Additionally, the top side 200 may receive cam shafts configured to actuate intake and exhaust valves.

The exhaust side 204 includes an exhaust outlet 218 and a flange 220 surrounding an outlet 222 of the exhaust outlet 218. The exhaust outlet 218 may be in fluidic communication with a plurality of exhaust runners in fluidic communication with combustion chambers in the engine. The flange 220 includes mounting holes 224. Downstream components such as a turbine or an exhaust conduit may be attached to the flange 220. The exhaust outlet 218 may be in fluidic communication with a plurality of cylinders in the engine. Specifically, in the depicted example, the cylinder head 106 includes 4 cylinder portions. It will be appreciated that when the cylinder head 106 is coupled to the cylinder block 104, shown in FIG. 1, complete cylinders may be formed. Cutting plane 250 defines the cross-section shown in FIG. 4.

Figure 3:
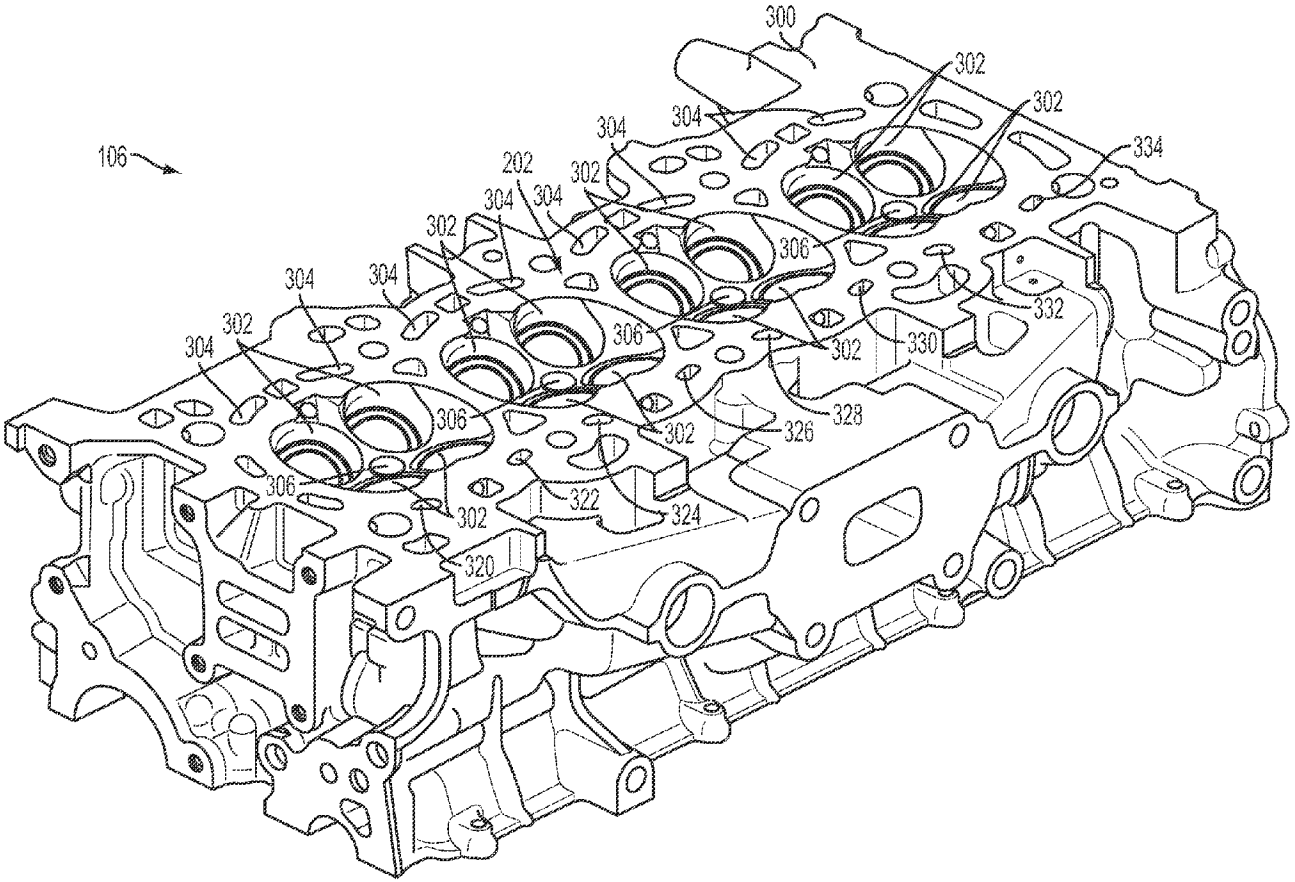
FIG. 3 shows a second view of the example cylinder head shown in FIG. 2.

FIG. 3 shows another perspective view of the example cylinder head 106, shown in FIG. 2. The bottom side 202 is depicted. The bottom side 202 includes a cylinder block engaging surface 300. The cylinder block engaging surface 300 is configured to attach to the cylinder block 104, shown in FIG. 1. As previously discussed, when the cylinder head 106 and the cylinder block 104 are coupled they form a plurality of combustion chambers. Pistons may be positioned within the combustion chambers and may be coupled to a crankshaft. The bottom side 202 further includes valve seats 302. As shown, there are four valve seats per cylinder. Thus, there are two intake valve seats and two exhaust valve seats per cylinder. The valve seats are configured to receive intake and exhaust valves. The cylinder head 106 further includes intake side vertical cylinder head cooling jacket passages 304 included in the cylinder head cooling jacket 126, shown in FIG. 1. Cylinder head 106 also include individually identified exhaust side vertical cylinder head coolant jacket passages 320-334. As shown, the intake side vertical cylinder head cooling jacket passages 304 extend into the cylinder head 106. Likewise, the exhaust side cylinder head vertical cooling jacket passages 320-334 extend into the cylinder head 106. Furthermore, the intake side vertical cylinder head cooling jacket passages 304 and the exhaust side vertical cylinder head coolant jacket passages 320-334 may be in fluidic communication with cylinder block cooling jacket passages included in the cylinder block cooling jacket 128, shown in FIG. 1. Additionally, ignition device ports 306 are also shown in FIG. 3. The ignition device ports 306 are configured to receive an ignition device such as a spark plug. However, in other examples, the ignition devices may be omitted from the engine and compression ignition may be utilized.

Figure 4:
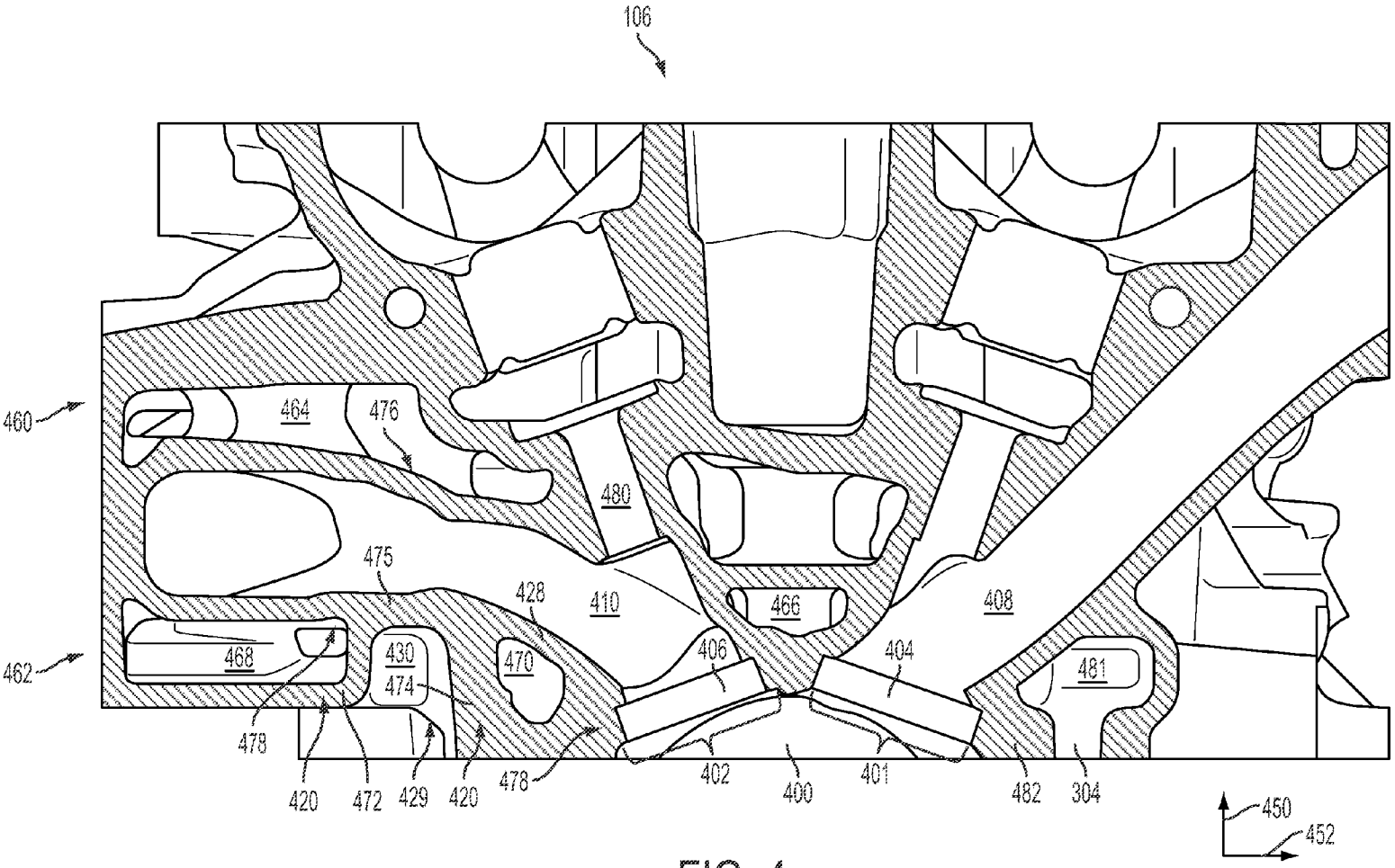
FIG. 4 shows a cross sectional view of the example cylinder head shown in FIG. 2.

FIG. 4 shows a cross-sectional view of the cylinder head 106 shown in FIGS. 2 and 3. A portion of a combustion chamber 400 is shown. When the cylinder head 106 is coupled to the cylinder block 104 shown in FIG. 1 an entire combustion chamber may be formed. The portion of the combustion chamber 400 includes an intake port 401 and an exhaust port 402. The intake port 401 includes an intake valve seat 404 and the exhaust port 402 includes an exhaust valve seat 406. The intake valve seat 404 and the exhaust valve seat 406 are included in the valve seats 302 show in FIG. 3. The cylinder head 106 further includes an intake runner 408 which leads to an intake manifold and an exhaust passage 410 included in the exhaust outlet 218, shown in FIG. 2, in fluidic communication with the portion of the combustion chamber 400. In the context of a multi-cylinder engine the exhaust passage 410 may be referred to as an exhaust runner. The exhaust passage 410 is in fluidic communication with the exhaust outlet—218, shown in FIG. 2.

The intake valve seat 404 is configured to receive an intake valve. Likewise, the exhaust valve seat 406 is configured to receive an exhaust valve. When closed, the intake valve may seat and seal on the intake valve seat 404. Likewise, when closed, the exhaust valve may seat and seal on the exhaust valve seat 406. However, when open, the intake valve enables fluidic communication between the portion of the combustion chamber 400 and the intake runner 408. Likewise, when open, the exhaust valve enables fluidic communication between the portion of the combustion chamber 400 and an exhaust passage 410. It will be appreciated that the intake and exhaust valves may be operated to permit intake and exhaust gas flow into the portion of the combustion chamber 400 to perform cyclical combustion. Furthermore, each intake and exhaust valve may be operated by an intake cam and an exhaust cam. Alternatively or additionally, one or more of the intake and exhaust valves may be operated by an electromechanically controlled valve coil and armature assembly.

A vertical axis 450 and a lateral axis 452 are provided for reference. However, it will be appreciated that the vertical axis 450 may or may not be aligned with the gravitational axis. Thus, it will be appreciated that the cylinder head 106 may be oriented in a variety of positions. An ignition device such as a spark plug may be coupled to the portion of the combustion chamber 400. However, in other examples the ignition device may be omitted from the cylinder head 106.

An upper coolant core 460 and a lower coolant core 462 are depicted. The upper coolant core 460 and the lower coolant core 462 are included in the cylinder head cooling jacket 126, shown in FIG. 1. The upper coolant core 460 is positioned vertically above the lower coolant core 462. Each of the cores may include a plurality of coolant passages. In particular, the upper coolant core 460 includes a first upper core coolant passage 464. The first upper core coolant passage 464 is positioned above the exhaust passage 410. The first upper core coolant passage 464 is configured to direct heat away from the exhaust passage 410.

Furthermore, the lower coolant core 462 is configured to direct heat away from the portion of the combustion chamber 400. The lower coolant core 462 also includes a first lower core coolant passage 468, a second lower core coolant passage 470, and another lower core coolant passage 466. The first lower core coolant passage 468 and the second lower coolant passage 470 lie along a lateral axis parallel to lateral axis 452. At least a portion of the first lower core coolant passage 468 is separated from the second lower core coolant passage 470 via a first wall 472 and a second wall 474. The first wall 472 forms one side of the first lower coolant passage 468 and the second wall 474 forms one side of the second lower core coolant passage 470.

The first lower core coolant passage 468 is positioned on a first side 475 of the exhaust passage 410 and where the upper coolant core 460 is positioned on a second side 476 of the exhaust passage 410. As shown, the first wall 472 and the second wall 474 are position on an exhaust side 478 of the portion of the combustion chamber 400. The first wall 472, second wall 474, and recess 429, discussed in greater detail herein, may be included in an exterior wall 420 forming one side of the first coolant passage 468 and the second coolant passage 470.

Figure 5:
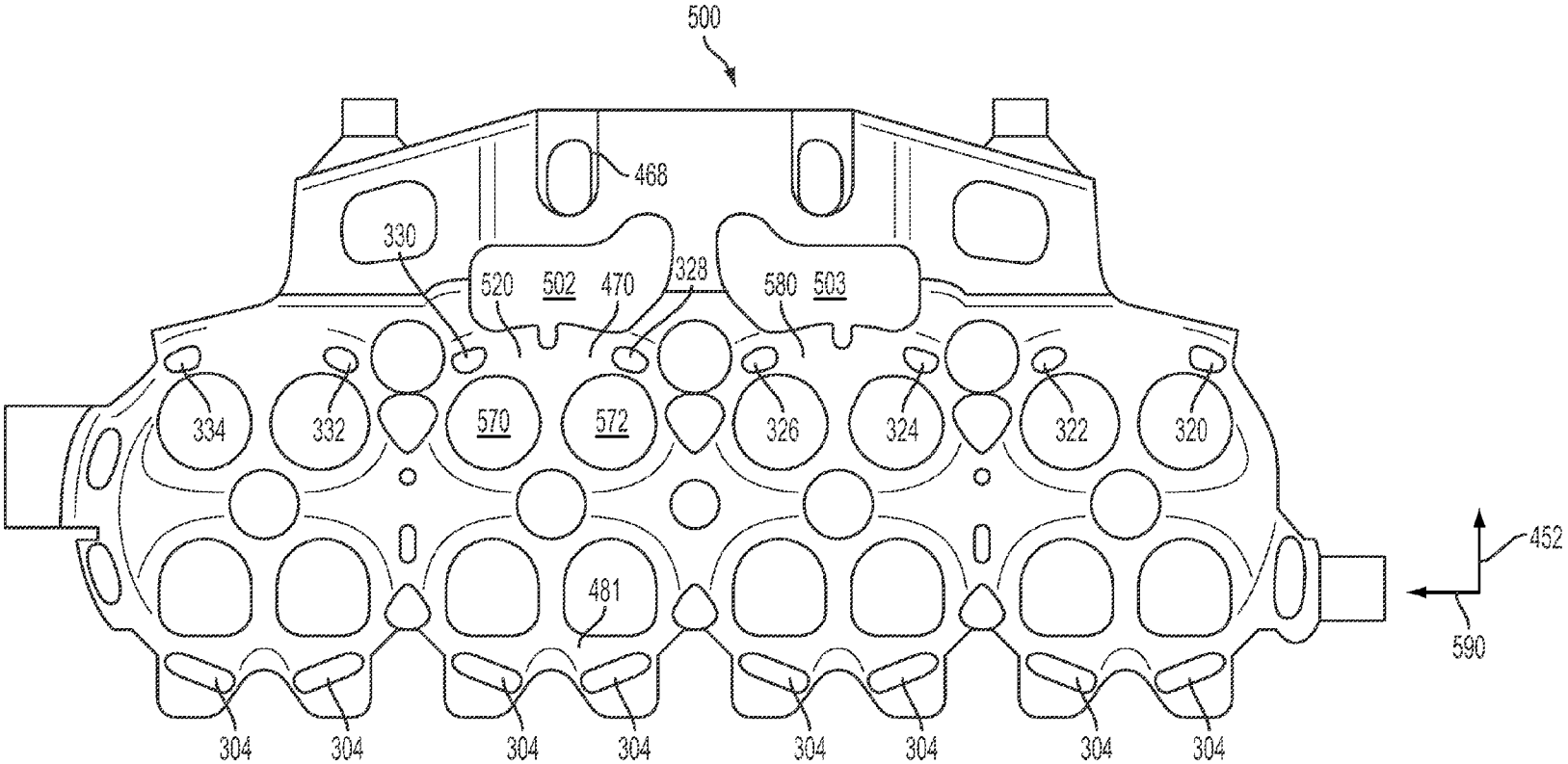
FIG. 5 shows an example lower core of the cylinder head shown in FIG. 2.

The cylinder head 106 further includes a recess 429 forming a void 502 in lower coolant core 462 as shown in FIG. 5. Recess 429 is positioned between the first lower core coolant passage 468 and the second lower core coolant passage 470. It will be appreciated that when the void is positioned between first and second lower core coolant passages (468 and 470), the cooling of the exhaust runner is reduced thereby changing the structural response of the cylinder head during engine operation. Thus, the mechanical loading that may distort the exhaust valve seat is reduced.

Cylinder head 106 also includes an intake side coolant passage 481 which is part of lower coolant core 462. Intake side vertical cylinder head cooling jacket 304 is shown extending from cylinder block engaging surface 300 to lower coolant core 462. Each engine cylinder includes passages similar to those shown in FIG. 3.

FIG. 5 shows a lower core 500 of the cylinder head 106 shown in FIG. 2. It will be appreciated that the lower core may define coolant passages in the lower coolant core 462 in the cylinder head 106. The lower coolant core 462 includes voids 502 and 503 formed by recess 429 shown in FIG. 4. It will be appreciated that when the void 502 is included in the core 500, the structural response near the exhaust side of the exhaust valve seats is changed. As a result, warping that may be caused by uneven mechanical loading is reduced.

Exhaust side vertical cylinder head coolant jacket passages 320-334 extend vertically from the lower coolant core 462 when the lower coolant core 462 is viewed from a bottom side that extends to cylinder block engaging surface 300. It can be seen that exhaust side vertical cylinder head coolant jacket passages 320-334 are smaller than intake side vertical cylinder head coolant jacket passages 304.

The second lower core coolant passage 470 spans a distance between two exhaust valve guides of a portion of the combustion chamber 400. For example, as shown second lower core coolant passage 470 extends from exhaust port lower coolant core void 570 to exhaust port lower coolant core void 572. One of the valve guides 480 is shown in FIG. 4. The first, second, and third cooling passages (468, 470, 580) lie along a lateral axis parallel to lateral axis 452. Engine cylinders are aligned along longitudinal axis 590. At least a portion of the third coolant passage 580 is separated from the first coolant passage via a third wall which is a mirror image of first wall 472 and a fourth wall which is a mirror image of second wall 474. Additionally, the lower coolant core 462 includes an exhaust side vertical cylinder head coolant jacket passage 328 extending from the cylinder block engaging side 300 of the cylinder head 106 to the second coolant passage 470.

Figure 6:
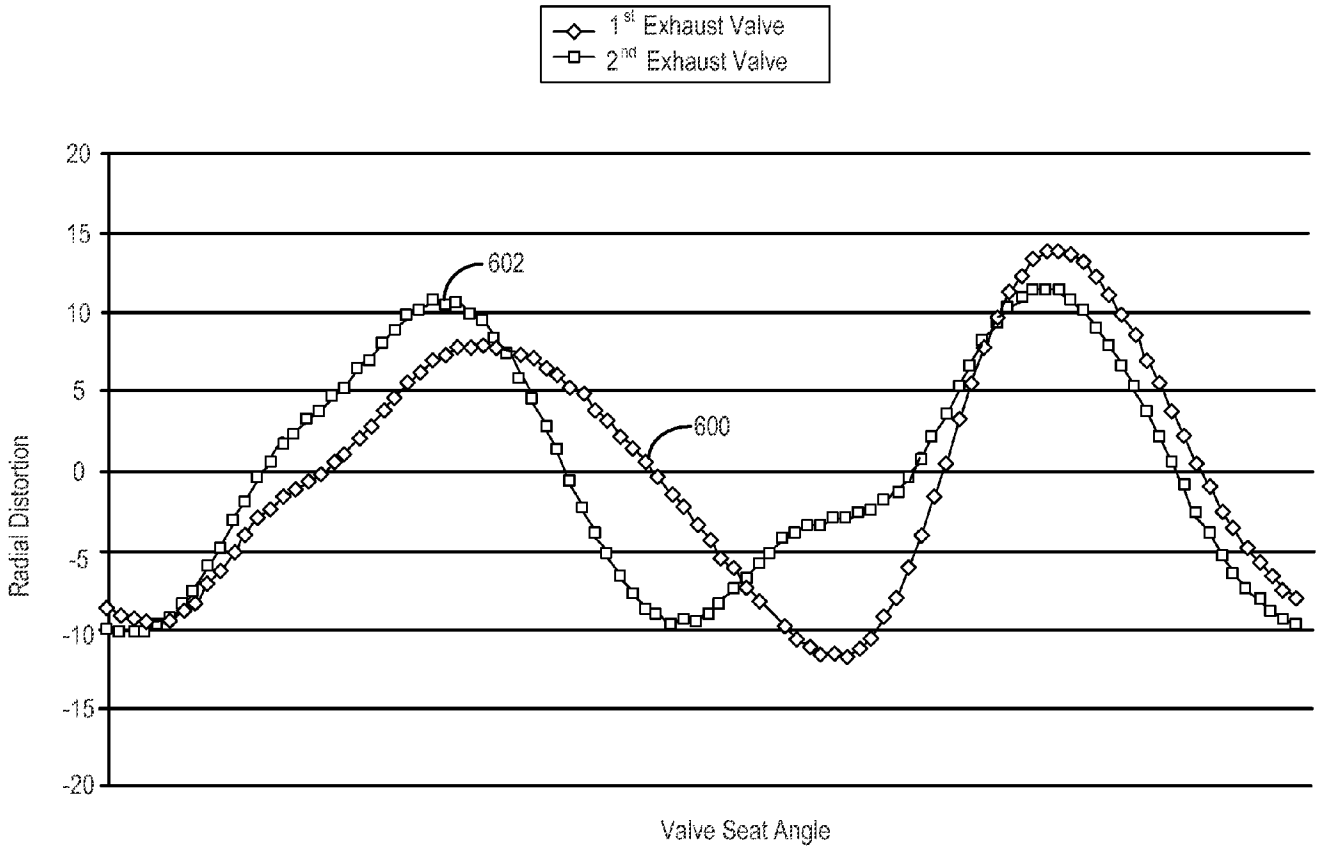
FIGS. 6 and 7 show graphs depicting the radial distortion of a valve seat vs. the crank angle.
Figure 7:
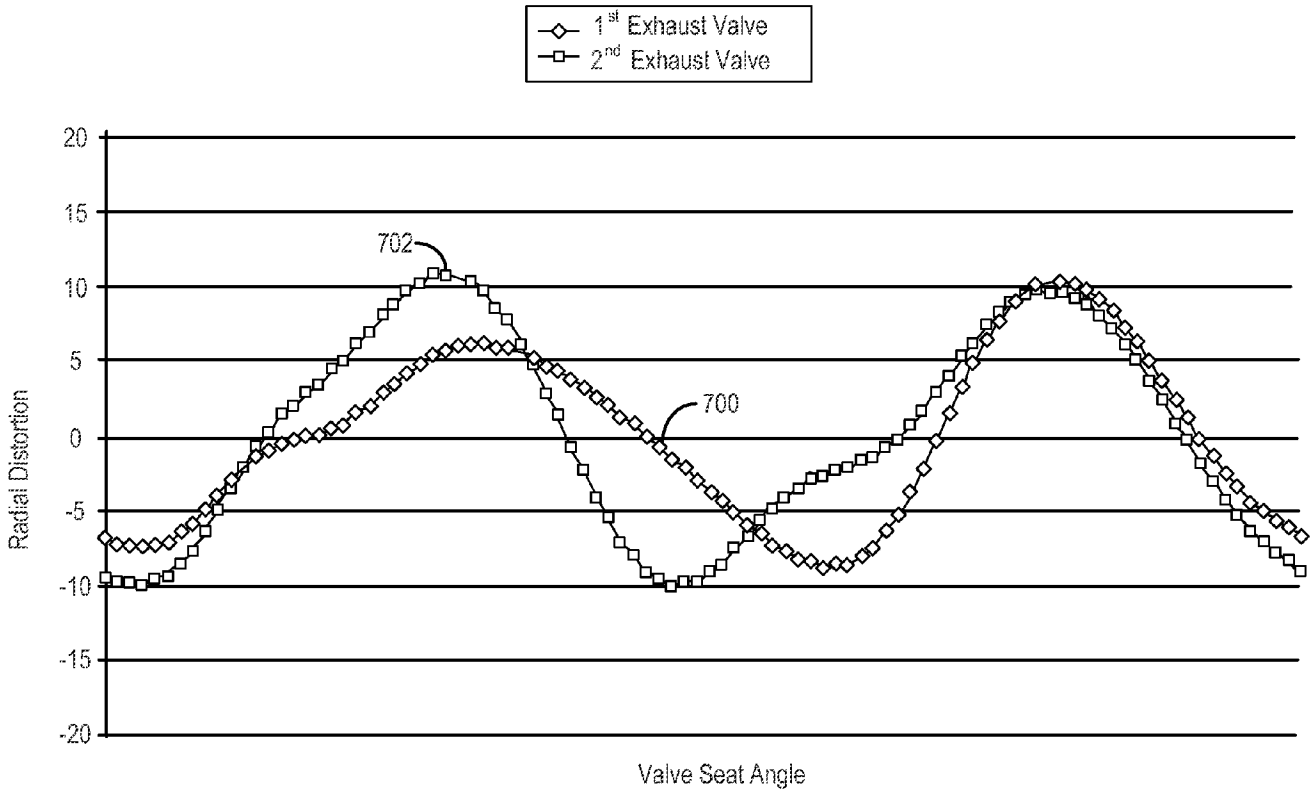
Figure 8:
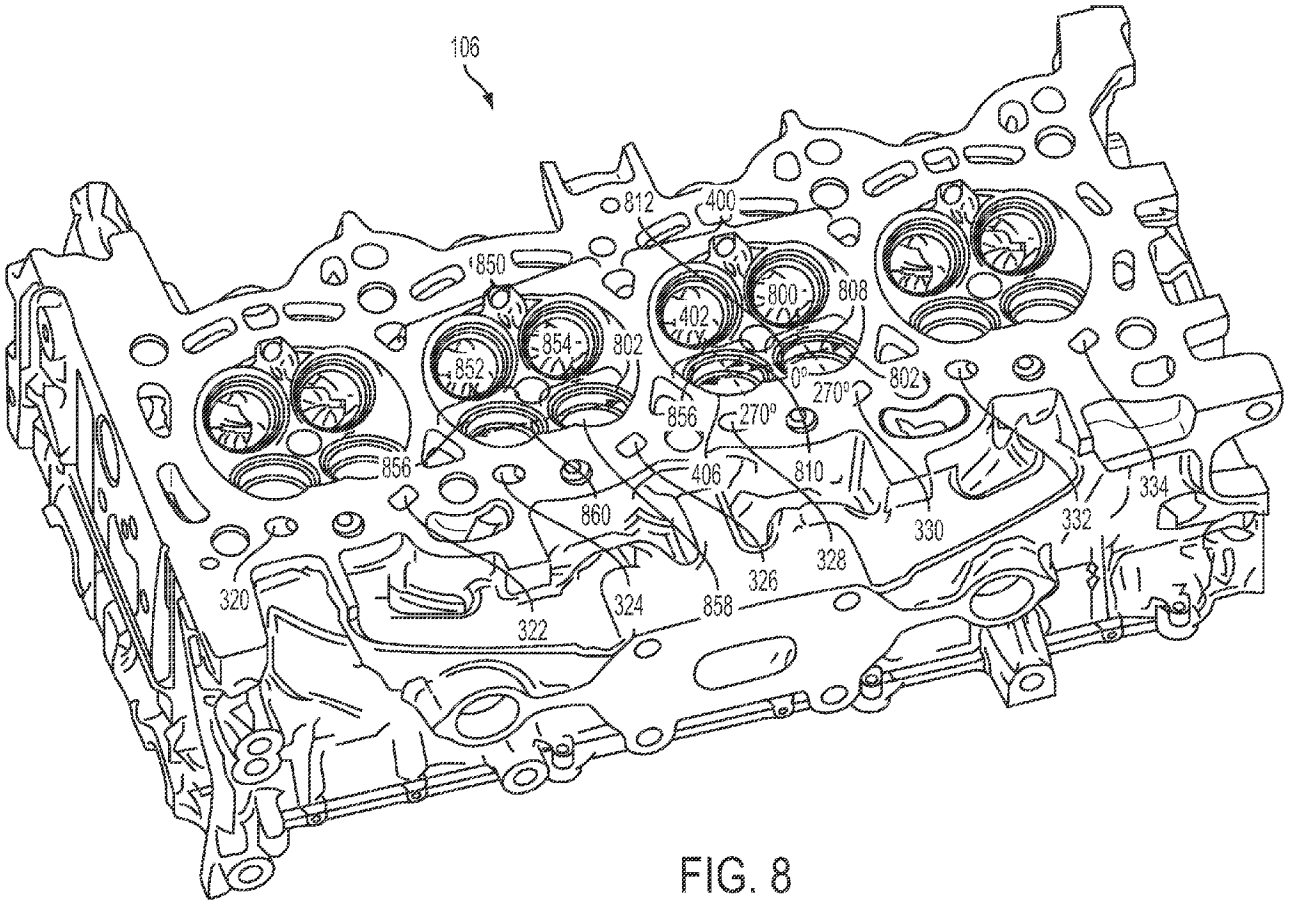
FIG. 8 shows another view of the cylinder head shown in FIG. 2.

FIGS. 6 and 7 show graphs indicating the radial distortion of an exhaust valve seat versus valve angle measured as described in FIG. 8. The radial exhaust valve seat distortion is on the y-axis and the angle is on the x-axis. Specifically, FIG. 6 shows a plot 600 depicting the radial exhaust valve seat distortion versus a radial angle of a first valve seat in a first cylinder of an engine having a cooling jacket with a large coolant thermal mass adjacent to the valve seat. Plot 602 depicts the radial exhaust valve seat distortion versus a radial angle of a second exhaust valve seat in the first cylinder of the engine having the cooling jacket adjacent to the valve seat and extending along an exhaust runner. The radial angle of the plot 600 is measured in a counterclockwise or clockwise direction described in FIG. 8. The radial angle of plot 602 is measured in a clockwise direction from a centerline longitudinally extending across the valve.

FIG. 7 shows a plot 700 depicting the radial exhaust valve seat distortion versus a radial angle of a first exhaust valve seat in a first cylinder of an engine assembly having a similar configuration to the example shown in FIG. 2. Additionally, FIG. 7 also shows a second plot 702 depicting the radial exhaust valve seat distortion versus a radial angle of a second exhaust valve seat in the first cylinder of the same. As shown, the radial distortion of the valve seats is decreased in FIG. 7. The radial angle of the plot 700 is measured in a counterclockwise direction from a centerline 810, shown in FIG. 8, longitudinally extending across the valve. The radial angle of plot 702 is measured in a clockwise direction from a centerline 810, shown in FIG. 8, longitudinally extending across the valve.

Referring now to FIG. 8, a second perspective view of the bottom side 202 of cylinder head 106 is shown. A portion of the combustion chamber 400 includes a second exhaust port 800 having second exhaust valve seat 802. The first exhaust port 402 and the first exhaust valve seat 406 are also shown in FIG. 8. The exhaust side vertical cylinder head coolant passage 328, shown in FIGS. 3 and 5, may be entirely within a region between 180 and 270 degrees measured in a counterclockwise direction indicted by arrow 810 from a material between the first and second exhaust valve seats (402 and 802), shown in FIG. 8, on a bottom side 300 of the cylinder head 106 and beginning at exhaust port centerline 808 of the first and second exhaust valve seats (402 and 802). Exhaust port 402 includes markings at 0° and 270° to indicate the angle around exhaust port 402.

The angle around exhaust port 800 is defined in a clockwise manner indicated by arrow 812. The angle around exhaust port 800 begins at exhaust port centerline 808 and the material between exhaust valve seats 402 and 802. The angle increases in a clockwise direction. Thus, as shown, the angle around second exhaust port 800 begins at 0° and proceeds clockwise to the 270° marker before returning back to the 0° marker. Thus, exhaust side vertical cylinder head coolant jackets 328 and 330 lay entirely within a range of from 180°-270° of the respective exhaust ports 402 and 800.

Additionally, FIG. 8 shows the cylinder head 106 including a portion of a second combustion chamber 850. In the context of an inline 4 cylinder engine, the portion of the first combustion chamber 400 and the portion of the second combustion chamber 850 are inner combustion chambers. In other words, the first and second combustion chambers may be interposed by two peripheral combustion chambers. However, other cylinder arrangements may be utilized. The portion of the second combustion chamber 850 includes a first exhaust port 852 and a second exhaust port 854. The first exhaust port 852 includes an exhaust valve seat 856. Likewise, the second exhaust port 854 includes an exhaust valve seat 858. In some examples, the first and second combustion chambers (400 and 850) are adjacent and where the first recess 429, shown in FIG. 4, is a mirror image of the second recess. The first recess 429, shown in FIG. 4, and the second recess may be positioned between the first and second combustion chambers (400 and 850) and the flange 220, shown in FIG. 2.

It will be appreciated that the lower coolant core 462 may also direct heat from the second combustion chamber 850. A third coolant passage 580 included in the lower coolant jacket 462, shown in FIG. 5 may be positioned adjacent to the portion of the second combustion chamber 850, shown in FIG. 8. In some examples, the third coolant passage 580 may be similar in geometry and position to the second coolant passage 470, shown in FIGS. 4 and 5. The second coolant passage 470, shown in FIG. 4, and the third coolant passage 580 may be positioned on an exhaust side of the first and second combustion chambers (400 and 850). Furthermore, the third coolant passage may include an exhaust side vertical cylinder head coolant jacket 326 which is entirely within a region between 180 and 270 degrees measured in a clockwise direction from exhaust port centerline 860 and the material between the exhaust valve seats (856 and 858) on a same side of the cylinder head 106 as the second combustion chamber 850. The exterior wall 420, shown in FIG. 4, may also include a second recess similar to the first recess 429 positioned on the exhaust side of the second combustion chamber 850. The recess forms a second void 503 shown in FIG. 5.

The engine assembly shown in FIGS. 1-5 and 8 provides for an engine cylinder head comprising a portion of a first combustion chamber, an upper coolant core, and a lower coolant core directing heat from the first combustion chamber and including a first coolant passage and a second coolant passage, the first coolant passage and the second coolant passage laying along a lateral axis, at least a portion of the first coolant passage separated from the second coolant passage via first and second walls.

The engine assembly shown in FIGS. 1-5 and 8 also provides for an engine cylinder head further comprising an exhaust runner within the cylinder head. The engine assembly shown in FIGS. 1-5 and 8 also provides for an engine cylinder head where the first coolant passage is positioned on a first side of the exhaust runner and where the upper coolant core is positioned on a second side of the exhaust runner. The engine assembly shown in FIGS. 1-5 and 8 also provides for an engine cylinder head where the first and second walls are positioned on an exhaust side of the first combustion chamber. The engine assembly shown in FIGS. 1-5 and 8 also provides for an engine cylinder head where the second coolant passage spans a distance between two exhaust valve guides of the first combustion chamber.

The engine assembly shown in FIGS. 1-5 and 8 also provides for an engine cylinder head further comprising a portion of a second combustion chamber, the lower coolant core directing heat from the second combustion chamber and including a third coolant passage, the first coolant passage and the third coolant passage laying along the lateral axis, at least a portion of the first coolant passage separated from the third coolant passage via third and fourth walls. The engine assembly shown in FIGS. 1-5 and 8 also provides for an engine cylinder head where the first combustion chamber is adjacent to the second combustion chamber.

The engine assembly shown in FIGS. 1-5 and 8 provides for an engine cylinder head comprising a portion of a combustion chamber and a lower coolant core directing heat from the combustion chamber and including a first coolant passage and a second coolant passage, the first coolant passage and the second coolant passage laying along a lateral axis, and a third passage extending from a block engaging side of the cylinder head to the second coolant passage.

The engine assembly shown in FIGS. 1-5 and 8 also provides for an engine cylinder head further comprising a first exhaust port with a first exhaust valve seat and a second exhaust port with a second exhaust valve seat, and where the third passage is entirely within a region between 180 and 270 degrees measured in a counterclockwise direction from a material between the first and second valve seats on a same side of the cylinder head as the combustion chamber and laying along a centerline of the first and second exhaust valve seats.

The engine assembly shown in FIGS. 1-5 and 8 also provides for an engine cylinder head further comprising a fourth passage extending from the engine block engaging side of the cylinder head to the second coolant passage. The engine assembly shown in FIGS. 1-5 and 8 also provides for an engine cylinder head where the third and fourth passages are positioned on an exhaust side of the combustion chamber.

The engine assembly shown in FIGS. 1-5 and 8 also provides for an engine cylinder head further comprising a third exhaust port with a third exhaust valve seat and a fourth exhaust port with a fourth exhaust valve seat, and where the fourth passage is entirely within a region between 180 and 270 degrees measured in a clockwise direction from the material between the third and fourth valve seats on a same side of the cylinder head as the combustion chamber and laying along a centerline of the third and fourth exhaust valve seats.

The engine assembly shown in FIGS. 1-5 and 8 also provides for an engine cylinder head including an exterior wall positioned between the first coolant passage and the second coolant passage. The engine assembly shown in FIGS. 1-5 and 8 also provides for an engine cylinder head where the lower coolant core includes a void between the first coolant passage and the second coolant passage.

The engine assembly shown in FIGS. 1-5 and 8 also provides for an engine cylinder head, comprising a portion of a first combustion chamber, a lower coolant core directing heat from the first combustion chamber and including a first coolant passage and a second coolant passage, the first coolant passage and the second coolant passage laying along a lateral axis, and an exterior wall forming one side of the first coolant passage and the second coolant passage, the exterior wall including a first recess positioned between the first coolant passage and the second coolant passage.

The engine assembly shown in FIGS. 1-5 and 8 also provides for an engine cylinder head where the recess forms a void in the lower coolant core between the first coolant passage and the second coolant passage. The engine assembly shown in FIGS. 1-5 and 8 also provides for an engine cylinder head further comprising a portion of a second combustion chamber, and where the exterior wall includes a second recess.

The engine assembly shown in FIGS. 1-5 and 8 also provides for an engine cylinder head where the second recess is positioned on an exhaust side of the second combustion chamber. The engine assembly shown in FIGS. 1-5 and 8 also provides for an engine cylinder head where the first and second combustion chambers are adjacent and where the first recess is a mirror image of the second recess. The engine assembly shown in FIGS. 1-5 and 8 also provides for an engine cylinder head further comprising an exhaust outlet flange directing exhaust from the first and second combustion chambers, and where the first and second recesses are positioned between the first and second combustion chambers and the exhaust outlet flange.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. An engine cylinder head, comprising:

a portion of a combustion chamber;

a lower coolant jacket adjacent to the portion of the combustion chamber and including a first lower coolant passage and a second lower coolant passage, the first lower coolant passage and the second lower coolant passage laying along a lateral axis, and a first vertical coolant passage extending from a block engaging side of the cylinder head to the second lower coolant passage;

an upper coolant jacket including a first upper coolant passage laying along a lateral axis, positioned above both the first lower coolant passage and the second coolant passage; and a recess positioned between the first coolant passage and the second coolant passage and positioned directly below the first upper coolant passage between a first end wall of the first upper coolant passage and a second end wall of the first upper lower coolant passage.

2. The cylinder head of claim 1, further comprising a first exhaust port with a first exhaust valve seat and a second exhaust port with a second exhaust valve seat, and where the first vertical coolant passage is entirely within a region between 180 and 270 degrees measured from a centerline of exhaust ports and in a counterclockwise direction from a first section of an exterior wall positioned between the first and second valve seats on a same side of the cylinder head as the combustion chamber.

3. The cylinder head of claim 1, further comprising a second vertical coolant passage extending from the engine block engaging side of the cylinder head to the second lower coolant passage.

4. The cylinder head of claim 3, where the first and second vertical coolant passages are positioned on an exhaust side of the combustion chamber.

5. The cylinder head of claim 3, further comprising a third exhaust port with a third exhaust valve seat and a fourth exhaust port with a fourth exhaust valve seat, and where the second vertical coolant passage is entirely within a region between 180 and 270 degrees measured from a center line of exhaust ports and in a clockwise direction from a second section of an exterior wall positioned between the third and fourth valve seats on a same side of the cylinder head as the combustion chamber.

6. The cylinder head of claim 4, including an exterior wall positioned between the first lower coolant passage and the second lower coolant passage.

7. The cylinder head of claim 1, where the lower coolant jacket includes a void formed by the recess between the first lower coolant passage and the second lower coolant passage.

* * * * *